United States Patent [19]

Fonio

[11] 4,349,306

[45] Sep. 14, 1982

[54] APPARATUS FOR LOADING WEB SUPPLY ROLLS INTO FOLDING MACHINES

[75] Inventor: Carlo Fonio, Galliate, Italy

[73] Assignee: Rockwell-Rimoldi, S.p.A., Milan, Italy

[21] Appl. No.: 175,628

[22] Filed: Aug. 6, 1980

[30] Foreign Application Priority Data

Sep. 25, 1979 [IT] Italy ..... 25967 A/79

[51] Int. Cl.[3] ..... B65G 65/02

[52] U.S. Cl. ..... 414/684; 414/911

[58] Field of Search ..... 414/245, 680, 684, 696, 414/721, 685, 688, 702, 705, 706, 707, 911; 242/58, 58.6; 270/42, 43; 271/3, 8 R

[56] References Cited

U.S. PATENT DOCUMENTS 830,035 9/1906 Zimmerman ..... 414/685

1,884,862 10/1932 Remde ..... 414/707 X 4,215,970 8/1980 De Salle ..... 414/684

*Primary Examiner*—John J. Love

*Assistant Examiner*—T. Lee Flower

[57] ABSTRACT

An apparatus attached to the movable carriage of a folding machine for depositing supply rolls of web material into the machine's roll supporting cradle. The apparatus includes a roll elevator frame and a roll guide frame pivotably attached to the carriage with a drive unit operatively connected to the elevator frame for raising and lowering both frames simultaneously between preselected positions. The drive unit pivots the elevator frame and supply roll carried thereby upwardly to a position where the roll is transferred to the roll guide frame and continued upward movement of the frame causes the supply roll to move along the guide frame and then into the machine's cradle.

6 Claims, 4 Drawing Figures

Fig. 1
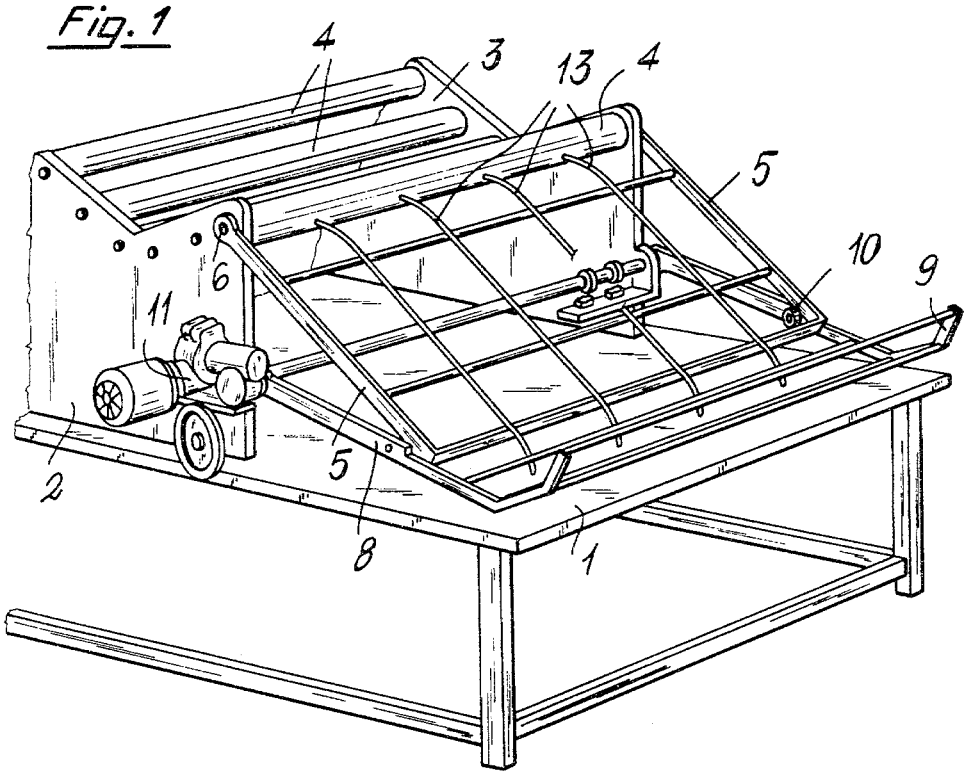
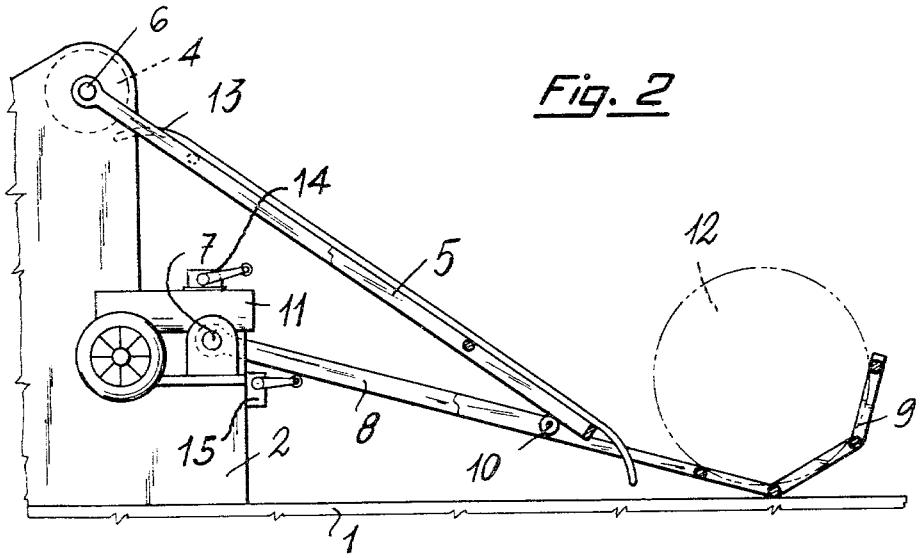
Fig. 2

Fig. 3
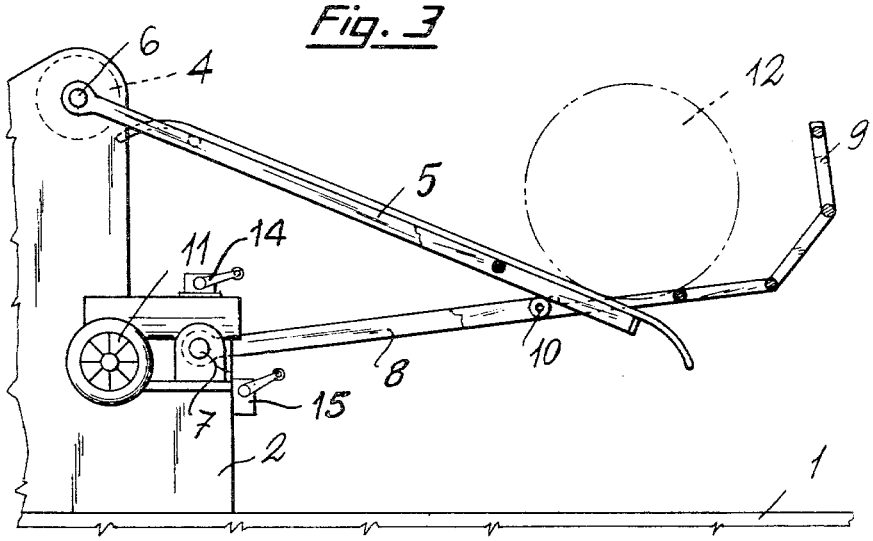
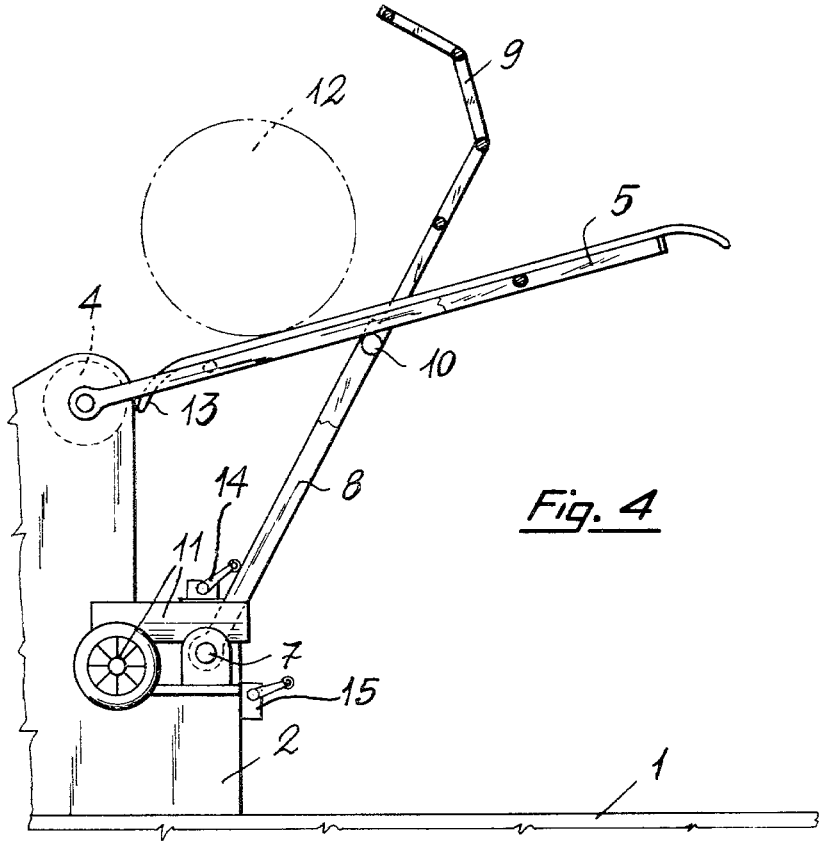
Fig. 4

APPARATUS FOR LOADING WEB SUPPLY ROLLS INTO FOLDING MACHINES

BACKGROUND OF THE INVENTION

The invention pertains to an apparatus for loading supply rolls of web material onto machines adapted to withdraw the web from its supply and more particularly to machines of the material folding type.

In many types of web processing machines, it is well known that the web supply rolls must be independently loaded onto the feed cradle which forms a part of the movable carriage of such machines. Prior to the instant invention, loading of folding machines has been a manual operation which is considered to have a number of disadvantages resulting from the excess weight of the supply rolls which on the average are in the neighborhood of 10 kilos. Weight of the supply rolls presents problems due to the height which they must be raised to be placed in the cradle of the machine. Frequently excessive force is used by those assigned to loading, that is to say the rolls are raised and released very quickly. It is not uncommon for the rolls to be released so that they drop into the cradle causing damage thereto and if not aligned with said cradle when released, they have been known to fall from the machine which, of course, can easily be the cause of injury to those in the vicinity.

A general object of the invention is to provide an apparatus applicable to a folding machine for automatically loading a web supply roll into the cradle thereof.

A further object is to provide an apparatus which will slowly raise the supply roll to a predetermined position and then cause said roll to move slowly into its operating position within the machine's cradle.

An additional object is to provide such an apparatus which is of simplified construction, reliable in operation and with long life expectancy.

SUMMARY OF THE INVENTION

The apparatus according to the invention includes an elevator frame pivotably attached to and extending from one end of the machine's cradle. A roll guide frame is also pivotably attached to the cradle above the elevator frame and is operatively engaged with the latter by means of anti-friction rollers for effecting simultaneous pivotable movement therewith. A variable speed drive unit is connected to the elevator frame which is adapted to support a web supply roll adjacent its free end. Actuation of the drive unit pivots the elevator frame and the roll guide frame associated therewith upwardly to a pre-selected position where by means of gravity the supply roll leaves said elevator frame and moves along said roll guide frame which guides the roll into its intended position within the cradle of the movable carriage.

Other objects and advantages of the invention will become more fully apparent by reference to the appended claims and as the following detailed description proceeds in reference to the figures of drawing wherein:

BRIEF DESCRIPTION OF THE DRAWINGS

FIG. 1 is a perspective view of a portion of a folding machine showing the apparatus according to the invention applied thereto; and FIGS. 2, 3 and 4 are views in side elevation showing the various positions of the elevator and roll guide frames for effecting the loading of a web supply roll.

DESCRIPTION OF THE PREFERRED EMBODIMENT

Referring now to the drawings, the apparatus is shown applied to a folding machine having a folding table 1 on which a movable carriage is mounted for reciprocating movement. The carriage includes a pair of spaced side plates 2 and 3 and the distance therebetween is traversed by a plurality of rotatably mounted rollers 4 which form a cradle for supporting supply rolls of web material that are adapted to be folded by the machine whose general construction and operation is well known and it is only considered necessary here to illustrate and describe those parts which are directly concerned with a preferred form of the present invention.

A roll guide frame identified by numeral 5 has one end thereof pivotably attached to the upper portion of the side plates 2 and 3 by means of pivot pins 6 the axes of which coincide with the axis of the uppermost roller 4 of the machine. Below the roll guide frame 5 an elevator frame 8 is supported in a similar manner to the side plates 2 and 3 by means of pivot pins 7. The end of the elevator frame 8 most remote from the pivot pins 7 is curved upwardly as at 9 for retaining a web supply roll 12 when in the position shown in FIGS. 1 and 2. Intermediate the ends of the elevator frame 8, each of the sides thereof has an anti-friction roller 10 mounted thereon which are disposed so as to engage the underside of the sides of the roll guide frame 5. The elevator frame 8 is operatively connected to a variable speed drive unit 11 which is effective in pivoting said frame on its pivot pins 7 between the upper position shown in FIG. 4 and its lower position shown in FIGS. 1 and 2. The variable speed drive unit is controlled by a pair of limit switches 14 and 15 which are disposed in operative association with the elevator frame 8 and serve to limit its pivotal movement between the upper and lower positions shown.

In FIG. 1 the elevator frame 8 is shown in its lowermost position where the curved end portion 9 engages the upper surface of the folding table 1. The folding table in the preferred embodiment is of a height approximately 80 cm from the floor which is considerably less than conventional tables. By providing a table of this height, the curved end 9 of the elevator frame 8 in its lower position provides a quick and simplified means for manually depositing a web supply roll thereon. The web supply roll shown by phantom lines in FIGS. 2, 3 and 4 is identified by numeral 12 and is caused to rest against the curved end 9 of the elevator frame 8 when placed on the latter as shown in FIG. 2.

After placement of the web supply roll as shown in FIG. 2 the drive unit 11 is actuated which causes the elevator frame 8 to be pivoted upwardly and the anti-friction rollers 10 carried thereby being in contact with the underside of the roll guide frame 5 effects simultaneous upward pivotal movement of the latter. When the elevator frame 8 is pivoted beyond the horizontal on its upward travel, the supply roll 12 rolls to that position shown in FIG. 3 where it engages the upper surfaces of the roll guide frame 5. Continued upward movement of the elevator frame 8 continues to move the roll guide frame 5 upwardly and when the latter moves beyond the horizontal, the web supply roll 12, as shown in FIG. 4, rolls toward and thence gently and unrestricted into the cradle of the machine which is formed by rollers 4.

It should be noted that the movement of the web supply roll 12 into the cradle as described is also facilitated by spaced rod elements 13 forming the upper surfaces of the roll guide frame 5, that are slightly inclined towards the roller 4 which is closest to the ends thereof.

With the apparatus of the invention it is possible to place a web supply roll onto a folding machine with a minimum of effort by simply placing said roll on the elevator frame when the latter is in its lowered position and then actuating the drive unit 11 which is effective in raising said roll to an elevated position whereat it will gently roll unrestricted and without possible damage thereto into the cradle of the machine.

Although the present invention has been described in connection with a preferred embodiment, it is to be understood that modifications and variations may be resorted to without departing from the spirit and scope of the invention as those skilled in the art will readily understand. Such modifications and variations are considered to be within the purview and scope of the invention and the appended claims.

I claim:

1. An apparatus for loading supply rolls of web material onto a folding machine of the type having a roll supporting cradle formed between spaced side plates of a movable carriage mounted for reciprocating movement on a folding table, said apparatus comprising:

(a) a roll guide frame (5) pivotably attached to and extending from one end of the spaced side plates;

(b) an elevator frame (8) pivotably connected to and extending from the spaced side plates in spaced relation below and in general alignment with said roll guide frame (5);

(c) means forming one end of said elevator frame (8) for supporting a web supply roll;

(d) drive means operatively connected to said elevator frame (8) for pivoting the latter upwardly and downwardly between preselected positions; and (e) means attached to said elevator frame (8) for raising said roll guide frame (5) simultaneously therewith to a position for receiving the supply roll from said elevator frame and guiding the same into the machine's cradle.

2. The structure according to claim 1 wherein said supporting means defines an upwardly directed end (9).

3. The structure according to claim 1 wherein said drive means defines a variable speed drive unit (11) fixedly mounted on one of the side plates.

4. The structure according to claim 3 wherein said variable speed drive unit (11) includes limit switches (14, 15) operatively associated therewith for controlling the upwardly and downwardly distance of travel of said elevator frame (8).

5. The structure according to claim 1 wherein said raising means defines an anti-friction roller (10) attached to each side of said elevator frame (8).

6. The structure according to claim 1 wherein said roll guide frame (5) includes a plurality of spaced rod elements (13) having inclined ends adjacent the machine's cradle for facilitating advance of the supply roll into the latter.

* * * * *